US005846353A

United States Patent [19]

Nazmy et al.

[11] Patent Number: 5,846,353

[45] Date of Patent: Dec. 8, 1998

[54] PROCESS FOR THE PRODUCTION OF A BODY OF MATERIAL STABLE AT HIGH TEMPERATURES FROM AN IRON-NICKEL SUPERALLOY OF THE TYPE IN 706

[75] Inventors: Mohamed Nazmy, Fislisbach; Markus Staubli, Dottikon, both of Switzerland

[73] Assignee: Asea Brown Boveri AG, Baden, Switzerland

[21] Appl. No.: 707,603

[22] Filed: Sep. 5, 1996

[30] Foreign Application Priority Data

Nov. 17, 1995 [DE] Germany ..... 195 42 919.2

[51] Int. Cl.[6] ..... C21D 6/02; C21D 8/00; C22F 1/10

[52] U.S. Cl. ..... 148/707; 148/538

[58] Field of Search ..... 148/707, 538

[56] References Cited

U.S. PATENT DOCUMENTS

| | | | |
|---|---|---|---|
| 4,445,943 | 5/1984 | Smith, Jr. et al. | 148/707 |
| 5,415,712 | 5/1995 | Thamboo | 148/707 |

FOREIGN PATENT DOCUMENTS

| | | | |
|---|---|---|---|
| 46-009546 | 3/1971 | Japan | 148/707 |
| 5295497 | 11/1993 | Japan | 148/707 |
| 6330161 | 11/1994 | Japan | 148/707 |

OTHER PUBLICATIONS

"Die Ursachen der hohen Warmfestigkeit von Superlegierungen", Metall—36 Jahrgang—Heft 5, May 1982, pp. 531–535.

"Nickel und Nickellegierungen", K.E. Volk, 1970, pp. 248–257.

"Heat Treatment of 706 Alloy for Optimum 1200° F. Stress–Rupture Properties", Moll, et al., Metallurgical Tansactions, vol. 2, Aug 1971, pp. 2153–2160.

*Primary Examiner*—Margery Phipps
*Attorney, Agent, or Firm*—Burns, Doane, Swecker & Mathis, L.L.P.

[57] ABSTRACT

A process for the production of a body of material stable at high temperatures. In this process, the body of material is formed by solution annealing and subsequent precipitation hardening of a hot work-hardened starting body composed of an iron-nickel superalloy of the type IN 706 provided in a furnace. The body of material is distinguished by a particularly high ductility in combination with high hot strength if the solution-annealed starting body is cooled from the annealing temperature envisaged for the solution annealing to the temperature envisaged for the precipitation hardening at a cooling rate of between 0.5° and 20° C./min.

10 Claims, No Drawings

PROCESS FOR THE PRODUCTION OF A BODY OF MATERIAL STABLE AT HIGH TEMPERATURES FROM AN IRON-NICKEL SUPERALLOY OF THE TYPE IN 706

BACKGROUND OF THE INVENTION

1. Field of the Invention

The invention relates to a process for the production of a body of material stable at high temperatures by solution annealing and subsequent precipitation hardening of a hot work-hardened starting body composed of an iron-nickel superalloy of the type IN 706 provided in a furnace. A body of material of this kind is distinguished by high strength at temperatures of around 700° C. and is therefore used to advantage in heat engines such as, in particular, gas turbines.

2. Discussion of Background

The invention makes reference to a prior art such as that which is described by J. H. Moll et al. "Heat Treatment of 706 Alloy for Optimum 1200° F. Stress-Rupture Properties" Met. Trans. 1971, Vol. 2, pp. 2153–2160.

From this prior art, it is known that the properties of the alloy IN 706 which are critical for its use as a material for components subject to thermal stress, such as, in particular, its hot strength and ductility, are determined by correctly performed heat treatment processes. Depending on the microstructure of the starting body forged from the alloy IN 706, typical heat treatment processes comprise the following process steps:

- solution annealing of the starting body at a temperature of 980° C. for a period of 1 hour,
- cooling of the solution-annealed starting body with air,
- precipitation hardening at a temperature of 840° C. for a period of 3 hours,
- cooling with air precipitation hardening at a temperature of 720° C. for a period of 8 hours,
- cooling to 620° C. at a cooling rate of about 55° C./h,
- precipitation hardening at a temperature of 620° C. for a period of 8 hours, and
- cooling with air, or
- solution annealing of the starting body at temperatures of around 900° C. for 1 hour,
- cooling with air,
- precipitation hardening at 720° C. for a period of 8 hours,
- cooling to 620° C. at a cooling rate of about 55° C./h, precipitation hardening at 620° C. for 8 hours and cooling with air.

SUMMARY OF THE INVENTION

Accordingly, one object of the invention is to provide a novel process of the type stated at the outset by means of which it is possible, in a simple manner, to create a body of material from the alloy of the type IN 706 which has a high ductility despite having a high hot strength.

The process according to the invention is distinguished, in particular, by the fact that it is simple to perform and avoids the formation of precipitates with an embrittling effect. A body of material produced by the process according to the invention has a tensile strength of about 600 MPa and figures for elongation at break of about 30% at temperatures of about 700° C. and is therefore eminently suitable as a starting material for the manufacture of a rotor for a large gas turbine subject to high thermal and mechanical stresses.

A more complete appreciation of the invention and many of the attendant advantages thereof will be readily obtained as the same becomes better understood by reference to the following detailed description.

DESCRIPTION OF THE PREFERRED EMBODIMENTS

Four commercially available forged starting bodies A, B, C, D composed of the alloy IN 706 were each separately introduced into a furnace and subjected to different heat treatment processes. The starting bodies each have the same microstructure and the same chemical composition. The following elements in percent by weight were determined as constituents:

| | |
|---|---|
| 0.01 | carbon |
| 0.04 | silicon |
| 0.12 | manganese |
| <0.001 | sulfur |
| 0.005 | phosphorus |
| 16.03 | chromium |
| 41.90 | nickel |
| 0.19 | aluminum |
| 0.01 | cobalt |
| 1.67 | titanium |
| <0.01 | copper |
| 2.95 | niobium |
| remainder | iron |

The composition of the starting bodies can fluctuate within the limiting ranges given below:

| | |
|---|---|
| max. 0.02 | carbon |
| max. 0.10 | silicon |
| max. 0.20 | manganese |
| max. 0.002 | sulfur |
| max. 0.015 | phosphorus |
| 15 to 18 | chromium |
| 40 to 43 | nickel |
| 0.1 to 0.3 | aluminum |
| max. 0.30 | cobalt |
| 1.5 to 1.8 | titanium |
| max. 0.30 | copper |
| 2.8 to 3.2 | niobium |
| remainder | iron |

The heat treatment processes for the four starting bodies are illustrated in table form below.

| Starting body | A | B | C | D |
|---|---|---|---|---|
| 3 h solution annealing in a furnace at 980° C. | x | x | | |
| 10 h solution annealing in a furnace at 925° C. | | | x | |
| 10 h solution annealing in a furnace at 910° C. | | | | x |
| Cooling with air | x | | | |
| Cooling in a furnace at about 1° C./min | | x | x | x |
| 10 h holding in the furnace at 820° C. | x | x | | |
| Cooling in a furnace at about 1° C./min | | x | x | x |
| 10 h holding in the furnace at 730° C. | x | x | | x |
| 48 h holding in the furnace at 730° C. | | | x | |
| Cooling in the furnace | x | x | x | x |
| 5 h holding in the furnace at 620° C. | x | | x | |
| 8 h holding in the furnace at 620° C. | | | | x |
| 16 h holding in the furnace at 620° C. | | x | | |
| Body of material | A' | B' | C' | D' |

From the bodies of material A', B', C' and D' resulting from this, rotationally symmetrical test pieces for tensile tests were turned. At their two ends, these test pieces were each provided with a thread which could be inserted into a test machine and each had a section in the form of a round bar with a diameter of 5 mm and a length of about 24.48 mm between two measuring marks. The test pieces were stretched until they broke at a temperature of about 705° C. and at a rate of about 0.01 mm/min. The values determined in this process for tensile strength and elongation at break are summarized in the table below.

| Body of material | A' | B' | C' | D' |
|---|---|---|---|---|
| Tensile strength at 705° C. MPa | 760 | 580 | 610 | 620 |
| Elongation at break at 705° C. % | 2.5 | 33 | 31.5 | 27.5 |

From these values it can be seen that, in the case of the bodies of material B', C' and D' produced by the process according to the invention, the elongation at break at 705° C. is about 10 to 12 times greater and the tensile strength a mere 20%, approximately, less than the elongation at break and tensile strength, respectively, in the case of the body of material D' produced by the process in accordance with the prior art. Bodies of material produced by the process according to the invention can be used to great advantage as rotors for large gas turbines since they have a sufficiently high hot strength and since, because of the high ductility of the material, unavoidable local temperature gradients can build up only small stresses locally.

The abovementioned properties are achieved with the alloy 706 if the solution-annealed starting body is cooled from the annealing temperature envisaged for the solution annealing to the temperature envisaged for the precipitation hardening at a cooling rate of between 0.5° and 20° C./min. If a cooling rate higher than 20° C./min is chosen, the elongation at break and hence also the ductility are severely reduced. If, on the other hand, a cooling rate less than 0.5° C./min is chosen, the process can no longer be carried out in an economic manner. A cooling rate of between 1° and 5° C./min is to be preferred.

Depending on the size of the starting body, the solution annealing should be carried out for a period of at most 15 h at temperatures of between 900° and 1000° C.

The precipitation hardening effected by holding at particular temperatures should preferably be carried out in a number of stages over a period of at least 10 h and at most 70 h. In the case of the precipitation hardening, the solution-annealed starting body should be heated to a temperature of between 700° and 760° C. in a first stage and held at this temperature for a period of at least 10 h and at most 50 h, and heated to a temperature of between 600° and 650° C. in a second stage and held at this temperature for a period of at least 5 h and at most 20 h.

The first stage of the precipitation hardening can be preceded by an additional heat treatment stage in which the solution-annealed starting body is held at a temperature of between 800° C. and 850° C. (body of material B').

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for the production of a body of material stable at high temperatures, the process comprising steps of: solution annealing and subsequent precipitation hardening of a hot work-hardened starting body composed of an iron-nickel superalloy having, in weight %, ≦0.02% C, ≦0.10% Si, ≦0.20% Mn, ≦0.002% S, ≦0.015% P, 15 to 18% Cr, 40 to 43% Ni, 0.1 to 0.3% Al, ≦0.30% Co, 1.5 to 1.8% Ti, ≦0.30% Cu, 2.8 to 3.2% Nb, balance Fe the starting body being cooled in a furnace at a cooling rate of between 1° and 5° C./min between the solution annealing and precipitation hardening steps, the precipitation hardening being preceded by an additional heat treatment stage in which the solution-annealed starting body is held at a temperature of between 800° C. and 850° C., the starting body being cooled at the rate of between 1° and 5° C. between the solution annealing and additional heat treatment steps and being cooled at the rate of between 1° and 5° C. between the additional heat treatment and precipitation hardening steps.

2. The process as claimed in claim 1, wherein the solution annealing step is carried out for a period of at most 15 hours at a temperature of between 900° C. and 1000° C.

3. The process as claimed in claim 1, wherein the precipitation hardening step is carried out in a number of stages over a period of at least 10 hours and at most 70 hours.

4. The process as claimed in claim 3, wherein, in the precipitation hardening step, the solution-annealed starting body is heat-treated in a first stage at a temperature of between 700° C. and 760° C. and in a second stage at a temperature of between 600° C. and 650° C.

5. The process as claimed in claim 4, wherein the first stage of the precipitation hardening is carried out over a period of at least 10 hours and at most 50 hours.

6. The process as claimed in claim 4, wherein the second stage of the precipitation hardening is carried out over a period of at least 5 hours and at most 20 hours.

7. The process as claimed in claim 4, wherein the transition from the first stage to the second stage is carried out by cooling in the furnace.

8. The process as claimed in claim 1, wherein the precipitation hardened body has a tensile strength at 700° C. of at least 600 MPa and elongation at break at 700° C. of at least 30%.

9. The process as claimed in claim 1, wherein the precipitation hardened body comprises a rotor for a gas turbine.

10. The process as claimed in claim 1, wherein the starting body is cooled at a rate of 1° to 5° C./min from a solution annealing temperature above 900° C. to a precipitation hardening temperature below 760° C.

* * * * *